US006321835B1

(12) United States Patent
Damsohn et al.

(10) Patent No.: US 6,321,835 B1
(45) **Date of Patent: *Nov. 27, 2001**

(54) HEAT TRANSFER DEVICE, PARTICULARLY EXHAUST GAS HEAT TRANSFER DEVICE

(75) Inventors: Herbert Damsohn, Aichwald; Conrad Pfender, Besigheim, both of (DE)

(73) Assignee: Behr GmbH & Co., Stuttgart (DE)

( * ) Notice: Subject to any disclaimer, the term of this patent is extended or adjusted under 35 U.S.C. 154(b) by 0 days.

This patent is subject to a terminal disclaimer.

(21) Appl. No.: 08/996,724

(22) Filed: Dec. 23, 1997

(30) Foreign Application Priority Data

Dec. 24, 1996 (DE) ..... 196 54 368

(51) Int. Cl.[7] ..... F28D 7/16; F28F 9/24; F28F 3/12; F28F 13/12

(52) U.S. Cl. ..... 165/159; 165/109.1; 165/162; 165/170; 165/172

(58) Field of Search ..... 165/162, 69, 148, 165/170, 109.1, 172, 159

(56) References Cited

U.S. PATENT DOCUMENTS

| | | | | |
|---|---|---|---|---|
| 877,609 | * | 1/1908 | Steiner | 165/148 |
| 989,185 | * | 4/1911 | Onions et al. | 165/DIG. 448 |
| 1,301,608 | * | 4/1919 | Satz | 165/DIG. 448 |
| 1,454,425 | | 5/1923 | Chapman et al. . | |
| 2,526,157 | * | 10/1950 | Ramen | 165/162 X |
| 2,601,973 | | 7/1952 | Jensen . | |
| 3,297,081 | * | 1/1967 | Nunemaker | 165/162 X |
| 3,757,855 | * | 9/1973 | Kun et al. | 165/148 X |
| 4,206,806 | | 6/1980 | Togashi . | |
| 5,803,162 | * | 9/1998 | Karbach et al. | 165/109.1 |

FOREIGN PATENT DOCUMENTS

| | | |
|---|---|---|
| 542 505 | 2/1985 | (AU) . |
| 34 16 840 | 11/1985 | (DE) . |
| 38 07 194 | 9/1988 | (DE) . |
| 39 04 250 | 8/1990 | (DE) . |
| 40 42 019 | 7/1992 | (DE) . |
| 0 677 715 | 10/1995 | (EP) . |
| 0 772 018 | 5/1997 | (EP) . |
| 339 401 | 6/1904 | (FR) . |
| 367 710 | 11/1906 | (FR) . |
| 494 885 | 9/1919 | (FR) . |
| 788 901 | 10/1935 | (FR) . |
| 1 400 582 | 4/1965 | (FR) . |
| 39 724 | 4/1961 | (LU) . |

* cited by examiner

*Primary Examiner*—Leonard Leo
(74) *Attorney, Agent, or Firm*—Crowell & Moring, LLP

(57) ABSTRACT

A heat transfer device, particularly an exhaust gas heat transfer device, having a tube bundle made of rectangular tubes for guiding the gas. A jacket surrounds the tube bundle; is used for guiding the liquid coolant and is equipped with a coolant inlet 17 and a coolant outlet 18. The rectangular tubes of the tube bundle 10 are provided with outwardly directed projections 22 which determine the distance of adjacent rectangular tubes with respect to one another and to the interior wall of the jacket 11.

2 Claims, 3 Drawing Sheets

HEAT TRANSFER DEVICE, PARTICULARLY EXHAUST GAS HEAT TRANSFER DEVICE

BACKGROUND AND SUMMARY OF THE INVENTION

This application claims the priority of German application 196 54 368.1, the disclosure of which is expressly incorporated by reference herein.

The invention relates to a heat transfer device, particularly an exhaust gas heat transfer device, having a tube bundle consisting of rectangular tubes used for guiding the gas and having a jacket which surrounds the tube bundle, which is used for guiding a liquid coolant and which is provided with a coolant inlet and a coolant outlet.

A heat transfer device of the initially mentioned type is the object of commonly assigned German Patent Application P 195 40 683.4 and counterpart U.S. patent application Ser. No. 08/743,002, the disclosure of which is expressly incorporated by reference herein.

It is an object of the invention to develop a heat transfer device of the initially mentioned type such that the rectangular tubes and optionally also the jacket can be implemented with small wall thicknesses while the stability is nevertheless sufficient even if the gaseous medium and/or the liquid coolant are supplied under a certain pressure.

This and other objects have been achieved in that the rectangular tubes are provided with outwardly directed projections which determine the distance of adjacent rectangular tubes with respect to one another and with respect to the interior wall of the jacket.

This and other objects have also been achieved by providing an exhaust gas heat transfer device, comprising: a tube bundle including rectangular tubes used for guiding a gas; and a jacket surrounding the tube bundle, said jacket being used for guiding a liquid coolant and being provided with a coolant inlet and a coolant outlet, said rectangular tubes being provided with outwardly directed projections which determine a distance between adjacent of rectangular tubes with respect to one another and with respect to an interior wall of the jacket.

This and other objects have also been achieved by providing an exhaust gas heat transfer device, comprising: a tubular jacket defining a gas flow entrance and a gas flow exit in a flow direction; a plurality of tubes arranged inside said tubular jacket extending longitudinally in said flow direction, each said tube having a rectangular cross-section defined by an upper side, a lower side, and a pair of lateral sides, an interior of said tubes being communicated with said gas flow entrance and said gas flow exit, a plurality of projections projecting externally from at least one of said upper side and said lower side, said projections engaging an adjacent of said tubes such that spaces are defined between said adjacent tubes, said spaces being sealed off from said gas flow entrance and said gas flow exit.

According to the invention, the rectangular tubes support each other during the assembly to form a bundle. The exterior rectangular tubes of the tube bundle are supported on the jacket. With this construction, rectangular tubes with a small wall thickness can be used, and nevertheless a high resistance to pressure is achieved. In addition, the projections influence the flow of the liquid coolant so that the heat transfer is improved. Since a continuous exchange of the liquid coolant takes place, an $O_2$-diffusion is prevented which could cause a crevice corrosion.

As a further development of the invention, the rectangular tubes are assembled of two U-shaped half-shells whose bottoms are provided with projections pressed to shape. This construction of the rectangular tubes permits economical manufacture.

In a further embodiment of the invention, the projections have an oval base whose largest dimension extends in the flow direction. Advantageously, it is further provided that the projections have an essentially semicylindrical cross-section transversely to the flow direction. Projections of this type are easy to form while they offer the advantage that a linear support is obtained on the respective adjacent rectangular tube.

In a further embodiment of the invention, the bottoms of the half shells are equipped with lugs which diverge in a V-shape in the flow direction. In this case, it is also expediently provided that the projections and the lugs are arranged successively in a regularly spaced manner. Expediently, the arrangement is made such that the projections of one half shell are arranged opposite lugs of the other half shell. This ensures that favorable flow conditions exist also inside the rectangular tubes, while the mounting of the projections does not interfere with the mounting of the lugs.

In a further development of the invention, the rectangular pipes are widened in a tulip shape and are gas-tightly connected with one another. This replaces a tube bottom which leads to a significant saving of weight and, in addition, to a simplified manufacture.

In order to produce the jacket in a simple fashion, the jacket is assembled of two preferably deep-drawn sheet metal shells which are profiled in the longitudinal direction of the tube bundle such that they follow the outer contour of the tube bundle at a distance corresponding to the height of the projections of the rectangular tubes. As a result, it is ensured that flow ducts exist also in the area of the exterior rectangular tubes of the tube bundle, which flow ducts essentially correspond to the cross-sections of the flow ducts between the remaining rectangular tubes.

In a further development of the invention, in the area of the ends of the tube bundle, the sheet metal shells each form a surrounding ring duct, in which case a coolant inlet is molded to one ring duct and a coolant outlet is molded to the other ring duct, and in which case the coolant inlet and the coolant outlet are preferably situated approximately diagonally opposite one another. The ring ducts provide a good distribution of the liquid coolant. If the coolant inlet and the coolant outlet are situated approximately diagonally opposite one another, coolant ducts of essentially the same length are obtained so that a uniform heat transfer is achieved in the whole area of the heat transfer device.

Other objects, advantages and novel features of the present invention will become apparent from the following detailed description of the invention when considered in conjunction with the accompanying drawings.

DETAILED DESCRIPTION OF THE DRAWINGS

Figure 1:
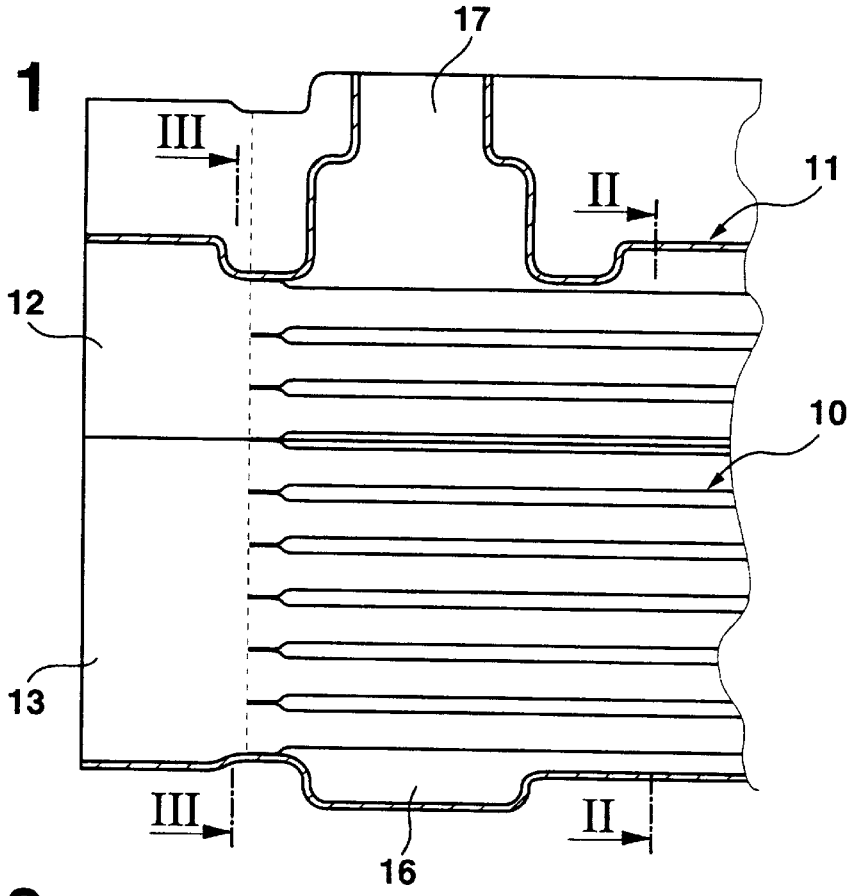
FIG. 1 is a partial longitudinal sectional view of an exhaust gas heat transfer device according to a preferred embodiment of the invention in the area of one end.
Figure 2:
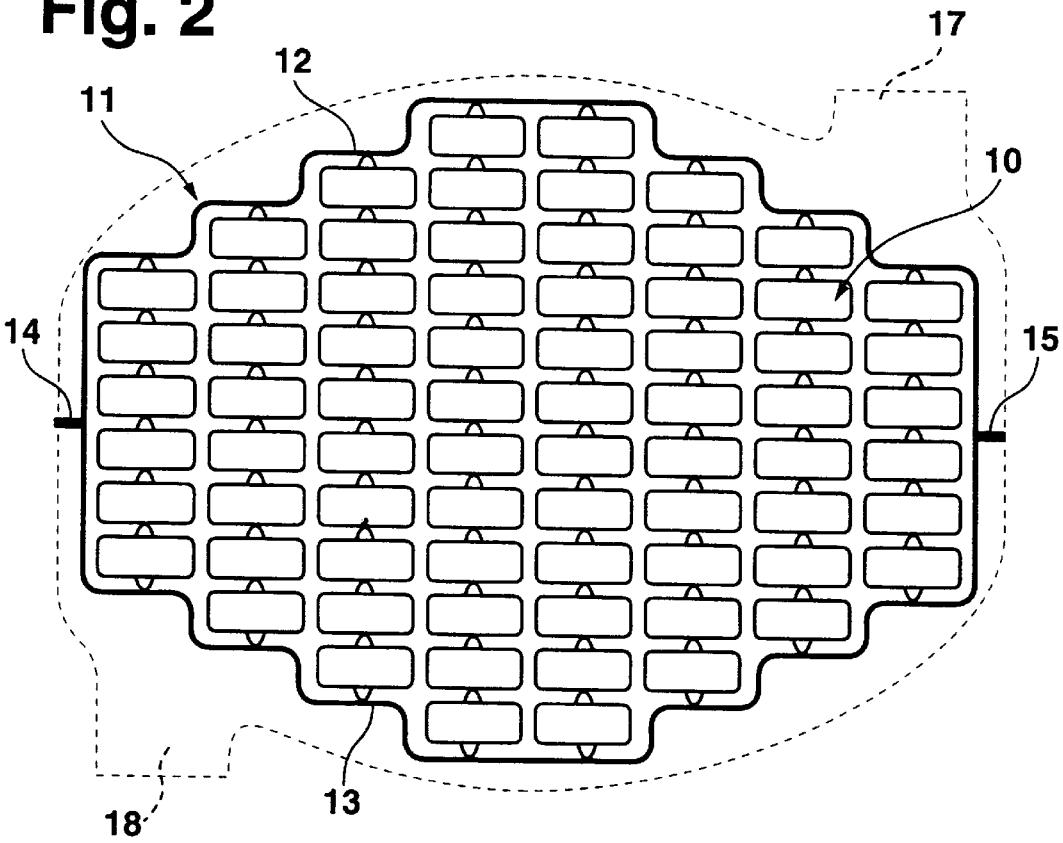
FIG. 2 is a sectional view along Line II—II of FIG. 1.
Figure 3:
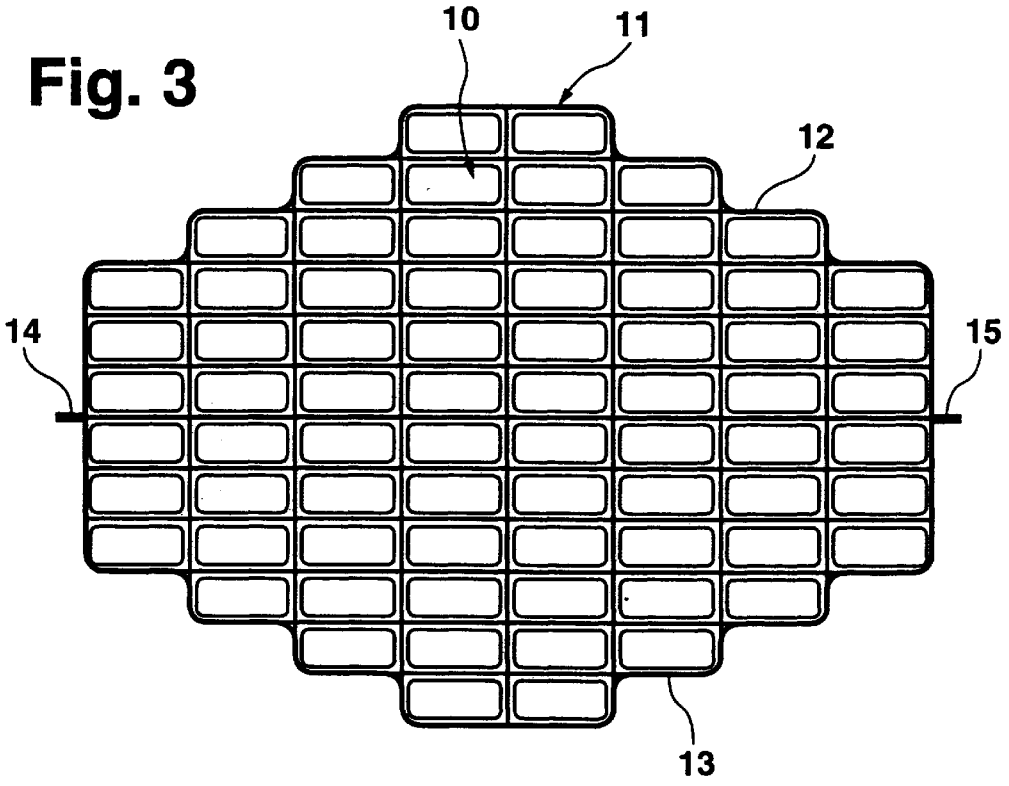
FIG. 3 is a sectional view along Line III—III of FIG. 1.

The exhaust gas heat transfer device illustrated in FIGS. 1–3 has a tube bundle 10 consisting of a plurality of identical rectangular tubes which are arranged at uniform distances such that they form approximately the contour of an ellipse. The rectangular tubes of the tube bundle 10, which will be explained later with reference to FIGS. 4 and 5, in the case of the illustrated embodiment, have a tulip shape on their ends; that is, they are widened such that, in the area of their ends, they rest flatly against one another. As illustrated in FIG. 3, these widened ends are gas-tightly connected with one another, for example, by welding or soldering.

The tube bundle 10 is surrounded by a jacket 11 which is assembled of two, preferably deep-drawn, sheet metal shells 12, 13. The two sheet metal shells 12, 13, which are tightly connected with one another on flanges 14, 15, for example, welded or soldered together, are formed such in a step-shaped manner that they follow the outer contour formed by the exterior rectangular tubes of the tube bundle 10 and are spaced from these exterior rectangular tubes at a distance which corresponds essentially to the distance of the rectangular tubes of the tube bundle 10 with respect to one another. In the area of the ends of the rectangular tubes of the tube bundle 10, the shells 12, 13 have a surrounding indentation so that they rest in this area against the ends of the rectangular tube of the tube bundle 10 and are gas-tightly connected with these, for example, are welded or soldered to them.

In the area of the ends of the rectangular tubes of the tube bundle 10, the two sheet metal shells are provided with shaped-out areas which form a surrounding ring duct 16. A coolant inlet 17 is molded to one of these ring ducts 16 and a coolant outlet 18 is molded to the other ring duct situated on the other end of the tube bundle 10. As illustrated in FIG. 2, the coolant inlet 17 and the coolant outlet 18 are situated essentially diagonally opposite one another so that flow ducts for the liquid coolant are obtained which have essentially the same length.

Figure 4:
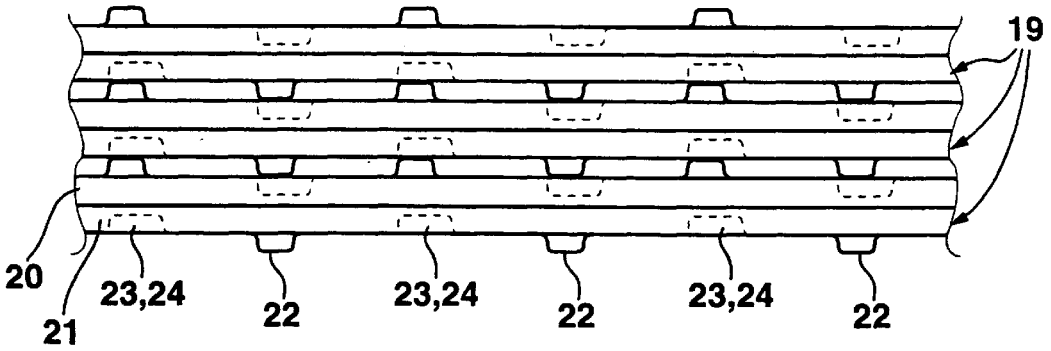
FIG. 4 is an enlarged lateral view of a cutout of three rectangular tubes of an exhaust gas heat transfer device according to the invention.
Figure 5:
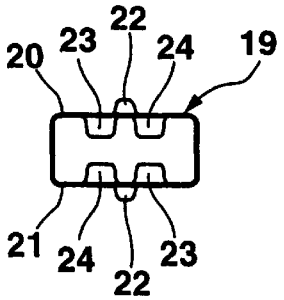
FIG. 5 is a frontal view of an individual rectangular tube of FIG. 4.
Figure 6:
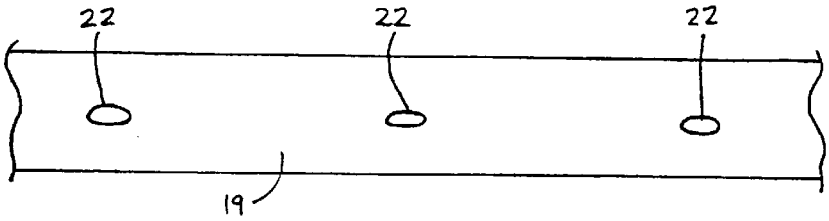
FIG. 6 is a top view of an individual rectangular tube of FIG. 4.

The tube bundle 10 consists of a plurality of rectangular tubes 19, in the case of the embodiment, of a total of seventy-two rectangular tubes 19 which are arranged mirror-symmetrically with respect to the vertical and to the horizontal longitudinal center plane and which extend with their flat sides in the horizontal direction and with their narrow sides in the vertical direction. FIGS. 4 and 5 are enlarged views of these rectangular tubes. Each rectangular tube 19 is composed of two U-shaped half shells 20, 21 which are connected with one another, preferably welded to one another, on their legs. In their center, the bottoms of the half shells 20, 21 are in each case provided with projections 22 which are pressed to shape and which are arranged at regular distances and project to the outside. The projections 22 have an essentially oval base (see FIG. 6) in the plane of the flat sides of the half shells 20, 21 and are shaped to the outside with an approximately semicylindrical cross-section. The height of these projections 22 corresponds to the distance between the facing flat sides of two adjacent rectangular tubes 19.

In practice, this height measures approximately 1.5 mm, with an overall height of the rectangular tubes of approximately 6 mm, for example.

Figure 7:
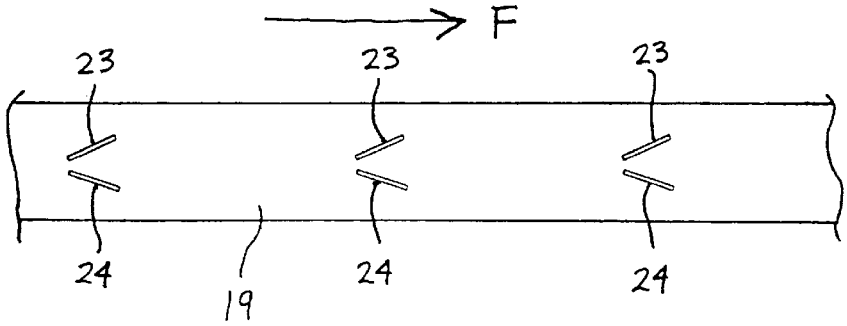
FIG. 7 is a bottom view of an individual rectangular tube of FIG. 4.

In the interior, the half shells 20, 21 are provided with inwardly projecting lugs 23, 24 which extend approximately along one fourth of the interior height of a flat tube. These lugs 23, 24, which have approximately a height of one fourth of the interior height of a rectangular tube 19, diverge in a V-shape (see FIG. 7) in the flow direction F at an angle of approximately 40°, in which case the forward ends of these lugs 23, 24 leave a space between one another.

The lugs 23, 24 arranged in pairs are arranged to be distributed in a regularly spaced manner along the length of the rectangular tubes 19. The distance between the pairs of lugs 23, 24 in the longitudinal direction of the rectangular tube 19 corresponds essentially to the spacing of the projections 22. As illustrated in FIG. 4, the half shells 20, 22 of a rectangular tube are offset with respect to one another in the axial direction such that a pair of lugs 23, 24 of one half shell 21 is situated opposite an outwardly pointing projection 22 of the other shell 20. The rectangular tubes 19 have an identical construction and are arranged such that they are supported with respect to one another via the projections 22 in the half division of the projections 22 of a rectangular tube 19.

In a modified embodiment, the ends of the rectangular tubes of the tube bundle are not deformed, that is, not widened. In contrast, they are fitted by means of both ends into tube bottoms and are fixedly and gas-tightly connected with these by means of soldering or welding. Such a tube bottom represents a grid which follows the outer contour of the jacket 11 and is provided with recesses corresponding to the rectangular tubes of the tube bundle 10. These tube bottoms are then gas-tightly welded into the jacket 11.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A heat transfer device comprising:

a tube bundle including rectangular tubes used for guiding a gas in a flow direction, and a jacket surrounding the tube bundle, said jacket being used for guiding a liquid coolant and being provided with a coolant inlet and a coolant outlet, said rectangular tubes being provided with outwardly directed projections which determine a distance between adjacent ones of said rectangular tubes with respect to one another and with respect to an interior wall of the jacket, said rectangular tubes each comprising two U-shaped half shells, each said half shell having a bottom provided with said projections pressed to shape, the bottoms of the half shells being provided with lugs which are arranged in pairs and diverge in the flow direction in a V-shape, the projections of one of the half shells being arranged opposite said pairs of lugs of an adjacent tube half shell.

2. An exhaust gas heat transfer device, comprising:

a tubular jacket defining a gas flow entrance and a gas flow exit in a flow direction;

a plurality of tubes arranged inside said tubular jacket extending longitudinally in said flow direction, each said tube having a rectangular cross-section defined by an upper side, a lower side, and a pair of lateral sides, an interior of said tubes being communicated with said gas flow entrance and said gas flow exit, a plurality of projections projecting externally from at least one of said upper side and said lower side, said projections engaging an adjacent one of said tubes such that spaces are defined between said adjacent tubes, said spaces being sealed off from said gas flow entrance and said gas flow exit, and a plurality of lugs projecting internally from at least one of said upper side and said lower side, said lugs being arranged in pairs and diverging in the flow direction in a V-shape, wherein each of said tubes includes half shells defining the upper and lower sides, and wherein the projections of one of the half shells are arranged opposite said pairs of lugs of an adjacent tube half shell.

* * * * *